United States Patent [19]

Emmons et al.

[11] 3,933,274

[45] Jan. 20, 1976

[54] PRODUCT FOR THE TREATMENT OF CELLULOSIC FABRICS

[75] Inventors: Stuart Albert Emmons, Cwmbran, Wales; John Leonard Metcalfe, Wirral, England; John Winston Potts, Ndola, Zambia

[73] Assignee: Lever Brothers Company, Maine

[22] Filed: Oct. 9, 1973

[21] Appl. No.: 404,539

Related U.S. Application Data

[63] Continuation of Ser. No. 287,406, Sept. 11, 1972, abandoned.

[52] U.S. Cl. ..... 222/94; 8/185; 38/144; 206/84; 222/137; 252/8.6; 260/29.4

[51] Int. Cl.[2] ..... B65D 35/22; B67D 5/06

[58] Field of Search ..... 260/29.4, 69–72, 260/84; 252/8.6; 117/11, 105.5; 8/116.3, 185; 38/144; 222/94

[56] References Cited

UNITED STATES PATENTS

| | | | |
|---|---|---|---|
| 2,795,513 | 6/1957 | Rossin | 117/105.5 X |
| 2,899,263 | 8/1959 | Nuessle et al. | 260/69 X |
| 2,941,900 | 6/1960 | Schröder-Stranz | 117/105.5 X |
| 3,055,773 | 9/1962 | Mosher | 260/29.4 X |
| 3,096,001 | 7/1963 | Boe et al. | 117/105.5 X |
| 3,297,611 | 1/1967 | Hill | 260/29.4 |
| 3,311,581 | 3/1967 | Pink | 260/29.4 |
| 3,535,151 | 10/1970 | Raffel et al. | 117/105.5 |

*Primary Examiner*—Joan E. Welcome
*Attorney, Agent, or Firm*—Arnold Grant, Esq.

[57] ABSTRACT

A product adapted for the treatment of cellulosic fabric comprises a container having at least two compartments for holding two or more fluent substances separate from one another but adapted for dispensing the substances simultaneously, and having in one compartment a resin precondensate and in another compartment a latent acid catalyst. The product is used to make aqueous solutions of both resin precondensates and latent acid catalysts for fabric treatment, whilst keeping the ingredients separate until required for use.

6 Claims, No Drawings

PRODUCT FOR THE TREATMENT OF CELLULOSIC FABRICS

This is a continuation of application Ser. No. 287,406, filed Sept. 11, 1972, now abandoned.

The present invention is concerned with the treatment of cellulosic fabrics to improve their crease-resistance and smooth-drying properties. In the term "cellulosic fabrics", we include fabrics made from both natural cellulosic fibres, for example cotton, and from regenerated cellulosic fibres, for example viscose rayon, or from mixtures of any of such fibres with non-cellulosic fibres.

The crease-resistance of cellulosic fabrics is commonly improved by cross-linking the cellulose molecules within the fibres. Formaldehyde is an effective cross-linking agent but in commercial use has been superseded by other cross-linking agents, such as resin precondensates of the urea-formaldehyde type. The cross-linking reaction is conducted under acidic conditions using a latent acid catalyst, which ideally only becomes strongly acidic on exposure to high temperatures so that it does not cause premature cross-linking when the cellulosic fabric is impregnated, or self-condensation of the resin-precondensate which is also caused by exposure to acidic conditions.

Cellulosic fabrics, particularly fabrics formed into garments, may thus be impregnated with aqueous solutions of resin-precondensates and latent-acid catalysts, partially dried and subsequently heated, for example by ironing, to cause the cross-linking to take place so that the fabric tends to retain the shape in which it was heated.

The latent-acid catalysts available are not sufficiently stable in admixture with resin precondensates to be added thereto much in advance of their use. It is conventional, therefore, to supply resin precondensates and latent-acid catalysts separately for fabric treatment. Whereas this is no significant disadvantage commercially, where the facilities are available for making up large batches of suitable impregnating solutions, the necessary separation of the resin precondensates and the latent-acid catalysts until immediately prior to their use is a distinct disadvantage for the domestic application of crease-resistant finishes to cellulosic fabrics.

It is an object of the present invention to provide in a single product of improved stability during storage both a resin precondensate and a latent-acid catalyst for the treatment of cellulosic fabrics to improve their crease-resistance.

According to this invention, a product comprising a container having at least two compartments for holding two or more fluent substances separate from one another but adapted for dispensing the substances simultaneously, has in one compartment a resin precondensate and in another compartment a latent acid catalyst. This product can readily be used to make aqueous solutions of both resin precondensates and latent acid catalysts for fabric treatment, whilst keeping the ingredients separate until they are required for use. This is particularly advantageous in facilitating the domestic application of crease-resistant finishes to cellulosic fabrics.

A preferred container which is particularly suitable for use in accordance with the invention comprises two mutually co-extensive outer walls of flexible sheet material and at least one inner wall of flexible sheet material which is co-extensive with the outer walls and acts as a partition between adjacent separate compartments, all the walls being secured together at the edge regions of the container.

With this arrangement the multi-compartment container or so-called "sachet" is opened by cutting into it from any point along an edge, or, when the sachet is rectangular or polygonal, by cutting off a corner with a pair of scissors or other suitable implement, and since all walls are out simultaneously, a multiple outlet is formed from which the liquids are dispensed simultaneously for use. The respective compartments preferably contain quantities of the resin precondensate and latent acid catalyst in the correct predetermined proportions for their use.

The resin precondensate and latent acid catalysts are preferably present in the form of aqueous solutions in the container. If the solutions are colourless and used in a multi-compartment sachet of the type described made from transparent heat-sealable film, the sachet is scarcely detectable as being of multi-compartment form and is virtually foolproof when used, except if the user does something unusual such as puncturing an outer wall when dispensing the contents. A simple precaution to facilitate simultaneous complete dispensing of the resin precondensate and the latent acid catalyst is to mark a line of cut across one corner or inwardly from one edge of the sachet. It will be appreciated that the solution used to impregnate cellulosic fabric should be colourless, but the contents of the sachet need not be colourless provided that any colour is discharged on mixing the ingredients to form the aqueous solution for fabric treatment.

Multi-compartment sachets may be made from two or more filled sub-sachets of the same size secured together at their edge regions, the filled sub-sachets being pre-made in the conventional manner by edge-sealing two webs to form a tube, cross-sealing the tube along a closure line, supplying liquids into the tube, and cross-sealing and cutting the tube along a second closure line spaced from the first closure line to separate a filled sub-sachet from the tube. In this case the or each inner wall comprises two layers of flexible sheet material face to face.

Alternatively, three or more webs can be edge-sealed to form a tube with one or more internal longitudinal inner walls, the cross-sealing and cutting to form spaced closure lines and separate filled sachets being repeated, and different liquids being supplied into the tube at opposite sides of the inner walls which act as partitions between adjacent separate compartments of the tube.

An alternative form of packaging which is convenient is a multi-compartment pressurised or manually pumped spraying container, particularly a so-called aerosol container. These can be made with a single spray nozzle connected to two or more compartments or with a separate nozzle for each compartment linked together to give simultaneous spray dispensing of the contents from the compartments. In the case of containers adapted for spray-dispensing, it is desirable to have the essential ingredients in aqueous solution at the desired concentrations for direct application to fabrics followed by heating, particularly by ironing, to effect the desired crease-proofing.

Suitable water-soluble resin precondensates are commercially available and include melamine-formaldehyde, urea-formaldehyde and substituted urea-formaldehyde resin precondensates, for example, dimethylol urea (DMU), di-(methoxy methylol) urea (DMMU), dimethylol ethylene urea (DMEU), di-(methoxy methylol) ethylene urea (DMMEU), dimethylol propylene urea (DMPU), and di-(methoxy methylol) propylene urea (DMMPU). On economic grounds DMU and DMEU are the preferred resin precondensates, but the latter has the advantage of being more resistant to attack by chlorine, with resultant yellowing, if the treated fabric is subsequently bleached. These compounds are commercially available but are usually sold in aqueous solution. However, the compounds may readily be synthesized, for example DMU may be isolated as a solid by reaction between formaldehyde and urea, and DMEU may be made as a solid, by reaction between ethylene urea and paraformaldehyde in methanol solution, followed by removal of the solvent.

Many suitable latent-acid catalysts are known and are commercially available. Latent-acid catalysts are usually inorganic salts, for example aluminium chloride, magnesium sulphate and perchlorate, sino nitrate, ammonium chloride, sulphate, nitrate and tartrate. The term is also used to include weak organic acids, for example citric acid and tartaric acid, which do not cause any substantial premature cross-linking or resin precondensate polymerisation but which are acidic enough during the conditions of curing to effect cross-linking to impart crease-resistance to treated fabric. The preferred latent-acid catalysts are ammonium salts, particularly ammonium chloride.

The amounts of the resin precondensate and latent acid catalyst in the container depend on the amount of aqueous solution of the materials to be made up for fabric treatment. The normal concentration of resin precondensate in water for the impregnation of cellulosic fabrics is about 3 to 5% by weight. The amount of latent acid catalyst is related to the amount of resin precondensate and is normally about 10 to 50%, preferably about 20 to 25%, by weight of the resin precondensate. Thus, the amounts of resin precondensate and latent acid catalyst in the container are chosen to provide aqueous solutions of these concentrations in amounts appropriate to the number and size of garments or fabric to be treated, the usual volumes being from about 1 pint to 1 gallon for domestic use. When the resin precondensate and latent acid catalyst are in aqueous solutions in the container, the concentration of the former is normally about 5 to 85%, preferably 25–70% by weight when the solution is adapted for further dilution in use, and the concentration of latent acid catalyst is from about 1 to about 40%, preferably about 5 to 20% by weight when the solution is adapted for further dilution in use.

Optional ingredients which may be used are, for example, stabilizers such as magnesium oxide; surfactants, preferably anionic surfactants; fabric softeners, for example quaternary ammonium compounds; and ironing aids, for example silicone compounds. Such optional ingredients may, if desired, be held in the containers in compartments separate from those containing the resin precondensates and latent acid catalysts. This is normally done only for ingredients which are unstable in the presence of the other ingredients, so as to improve the storage properties of the products. When the container has only two compartments, it is preferable to keep in separate compartments any cationic fabric softener and any silicone ironing aid used, the former preferably being with the resin precondensate rather than with the latent acid catalyst, because of their incompatibility in the same solution.

The invention is illustrated by the following Examples in which parts and percentages are by weight except where otherwise indicated.

EXAMPLE 1

A three compartment rectangular sachet was made by conventional techniques from transparent PVC film, and incorporated in one outer compartment 50 mls of a solution A, in a central compartment 10 mls of a solution B and in the other outer compartment 50 mls of a solution C. The ingredients of solutions A, B and C were as follows:

| Solution A | |
|---|---|
| Ingredient | Percentage Concentration |
| | (gas per 100 mls) |
| DMEU | 53.3 |
| Magnesium Oxide | 0.53 |
| Arquad 2C[1] | 0.89 |
| Water | to 100 |

| Solution B | |
|---|---|
| Ingredient | Percentage Concentration |
| | (gas per 100 mls) |
| Ironing aid Le 463[2] | 33.4 |
| Water | to 100 |

| Solution C | |
|---|---|
| Ingredient | Percentage Concentration |
| | (gas per 100 mls) |
| Ammonium chloride | 10.68 |
| Tween 40[3] | 1.0 |
| Perfume | 0.03 |
| Water | to 100 |

[1]di-oooo-dimethylammonium chloride, supplied by Armour Chemical Co. Ltd.
[2]35%, aqueous emulsion of a polydimethylsiloxane (viscosity 60,000 cs) supplied by Union Carbide Ltd
[3]polyoxyethylene sorbitan monopalmitate supplied by Honeywill Atlas Ltd To use the sachet described for crease-proofing cellulosic garments, all three components were opened simultaneously by cutting into the sachet from an edge (or by cutting off a corner), the contents were then poured into 1 pint of cold water and the resulting solution thoroughly mixed. A cellulosic garment was thoroughly impregnated with the solution and the surplus liquid was removed by a very brief spin-drying operation in a domestic spin-drier (average wet pick-up 57.2%). The garment was then ironed with a domestic hand iron set at normal cotton ironing temperature.

This procedure was followed for 25 different cotton garments, after which the garments were washed in an automatic machine and tumble dried. The garments were then assessed for their appearance in terms of the amount of ironing needed to restore their appearance. All the garments had improved crease-resistant properties and none required re-damping and full normal ironing to restore their appearance, the average requirement being a need for only touch-up ironing. The average Monsanto wash/wear rating for the treated garments was about 4.0, some individual garments having average ratings as high as 4.9.

EXAMPLE 2

A two-compartment sachet was made incorporating in one compartment 50 mls of a solution A and in the other compartment 50 mls of a solution B. The ingredients in solutions A and B were as follows:

Solution A

| Ingredient | Percentage Concentration |
|---|---|
| DMEU | 66.7 |
| Magnesium Oxide | 0.4 |
| Sodium Lauryl Sulphate | 0.2 |
| Perfume | 0.036 |
| Water | to 100 |

Solution B

| Ingredient | Percentage Concentration |
|---|---|
| Ammonium Chloride | 13.34 |
| Ironing Aid LE 463 | 10.0 |
| Water | to 100 |

The sachets were used to treat cellulosic garments by the procedure described in Example 1, with equally good results. All the treated garments had improved crease-resistant properties.

EXAMPLE 3

A two compartment container having a spray nozzle for each compartment connected so as to operate simultaneously by manually-operable pumping action had the following solutions in the containers.

Resin precondensate solution

| Ingredient | Percentage Concentration |
|---|---|
| DMEU | 20 |
| Softener (polyethylene 30% dispersion)[1] | 0.3 |
| Silicone Fluid[2] | 0.4 |
| Tween 40 | 0.02 |
| Water | to 100 |

Latent acid catalyst solution

| Ingredient | Percentage Concentration |
|---|---|
| Ammonium chloride | 4.0 |
| Magnesium oxide | 0.2 |
| Water | to 100 |

[1]Cirrasol PN obtained from ICI Ltd
[2]MS 200/350 (cs) obtained from Hopkin and Williams Ltd In use, the solutions were sprayed in equal proportions directly onto cotton fabrics to give an estimated 50% wet pick-up. In tests where the actual wet pick-up varied from 36.5% to 59%, the Monsanto Rating for the fabric smoothness after washing and tumbler drying in a Bendix washing machine was in all cases between 4.0 and 5.0.

EXAMPLE 4

A twin compartment aerosol dispensing container with a mixer nozzle and a dispensing ratio of 4 parts of one resin precondensate solution to 1 part of latent acid catalyst solution had the following ingredients in the solutions.

Resin precondensate solution

| Ingredient | Percentage concentration |
|---|---|
| DMEU | 5 |
| Magnesium oxide | 0.05 |
| Arquad 2C | 0.083 |
| Water | to 100 |

-continued

Latent acid catalyst solution

| Ingredient | Percentage concentration |
|---|---|
| Ammonium chloride | 4.0 |
| Silicone ironing aid LE 463 | 2.5 |
| Tween 40 | 0.02 |
| Perfume | 0.014 |
| Water | to 100 |

Cotton fabrics were sprayed to an estimated 80% or 50% wet pick-up and hand-ironed, and then examined for smooth-drying properties by washing and then tumbler-drying the fabrics in a Bendix washing machine. The fabrics had Monsanto Rating for smoothness of between 3.2 and 4.2, indicating much improved smooth-drying properties after treatment.

What is claimed is:

1. A product comprising a container having at least two compartments for holding at least two fluid substances separate from one another but adapted for dispensing the substances simultaneously, siad container having two mutually co-extensive outer walls of flexible sheet material and at least one inner wall of flexible sheet material which is co-extensive with the outer walls and acts as a partition between adjacent separate compartments, all the walls being secured together at the edge regions of the container, such that cutting into the container along at least one edge thereof will thereby cut into all the walls and provide a multiple outlet to simultaneously dispense fluids from each of the compartments, said container having in one compartment an aqueous solution of a substituted urea-formaldehyde resin precondensate, the concentration of the resin precondensate in the aqueous solution being from about 5 to 85% by weight, and in another compartment an aqueous solution of a latent acid catalyst selected from the group consisting of aluminum chloride, magnesium sulphate, magnesium perchlorate, zinc nitrate, ammonium chloride, ammonium sulphate, ammonium nitrate, ammonium tartrate and the weak organic acids citric and tartaric acid, the concentration of the latent acid catalyst in the aquous solution being from about 1 to 40% by weight, whereby an aqueous solution containing both the resin precondensate and the latent acid catalyst in the correct predetermined proportions for their use, with the amount of the latent acid catalyst being from about 10 to 50% by weight of the resin precondensate, may readily be used for the application of crease resistant finishes to cellulosic fabrics.

2. A product according to claim 1 wherein the walls of the container are rectangular.

3. A product according to claim 1, wherein the resin precondensate is dimethylol ethylene urea.

4. A product according to claim 1, wherein the latent acid catalyst is ammonium chloride.

5. A product according to claim 1, wherein the concentration of resin precondensate is from about 25 to 70% by weight.

6. A product according to claim 1 wherein the concentration of latent acid catalyst is from about 5 to 20% by weight.

* * * * *